US005433981A

United States Patent [19]

Chalfin

[11] Patent Number: 5,433,981

[45] Date of Patent: Jul. 18, 1995

[54] ORNAMENT ATTACHMENT ASSEMBLY FOR A TASSEL

[76] Inventor: Bernard Chalfin, 50 Mayflower Dr., Tenafly, N.J. 07670

[21] Appl. No.: 246,298

[22] Filed: May 19, 1994

Related U.S. Application Data

[63] Continuation-in-part of Ser. No. 961,118, Oct. 14, 1992, Pat. No. 5,338,586.

[51] Int. Cl.[6] ..... B44C 3/00; A44C 25/00

[52] U.S. Cl. ..... 428/28; 63/15; 63/15.45; 63/15.5; D11/26

[58] Field of Search ..... 428/28; 653/15, 15.45, 653/15.5

[56] References Cited

U.S. PATENT DOCUMENTS

| | | | |
|---|---|---|---|
| 635,510 | 10/1899 | Saunders | 63/15 |
| 1,003,696 | 9/1911 | Briggs | 63/15.5 |
| 1,269,491 | 6/1918 | Murray | 63/15 |
| 2,292,563 | 8/1942 | Imhoff | 63/15 |
| 3,105,243 | 10/1963 | Kampfe et al. | 428/28 |
| 5,338,586 | 8/1994 | Chalfin | 428/28 |

*Primary Examiner*—James C. Cannon

*Attorney, Agent, or Firm*—Michael R. Gilman; Gottlieb, Rackman & Reisman

[57] ABSTRACT

An ornament attachment assembly for a tassel and a method of using such an assembly is provided. The attachment assembly comprises attachment means comprised of a hook element and a suspension element. The shape of the hook element, orientation of the suspension element and the orientation of a lower portion of the tassel all combine to make attachment and detachment of the ornament less burdensome and more secure.

10 Claims, 6 Drawing Sheets

ORNAMENT ATTACHMENT ASSEMBLY FOR A TASSEL

This is a continuation-in-part of application Ser. No. 07/961,118, filed Oct. 14, 1992, now U.S. Pat. No. 5,338,586.

This invention relates to attachment means for detachably retaining an ornamental member on a tassel binding band and to a method for employing such means.

BACKGROUND OF THE INVENTION

Tassels are known for ornamental use, particularly in connection with graduation hats of the mortar board type. The tassels are normally formed by winding a tassel cord around a mandrel or over a frame a certain number of revolutions and then tying a hanging cord at a center point between the mandrel ends. The hanging cord is generally secured above and below the tassel cords, the usual methods of securing the hanging cord being by knotting, stapling, clamping and/or clipping. The tassel cords are then cut at the mandrel ends so that they hang down from the knots of the hanging cord. The tassel cords are then bound together at an area below the knots and above their cut ends with a tassel binding band.

It is also known to provide an attachment means as part of the binding band to retain an ornamental member. Such an ornamental member would normally display a graduation year.

It is necessary to mass produce these objects and to allow for the ornamental member to be removed so that a new one for the appropriate year may be substituted. This has been done conventionally by providing a prong extending from the binding band which can be bent with a pair of pliers into a closed loop that engages an opening in the ornamental member for holding the ornamental member securely to the tassel. This type of prior art attachment entails difficulty in attachment and removal on a mass production basis because of the large number of wrist and hand motions needed for this very repetitive task and has led to complaints of carpal injuries from workers. The prior art attachment has also been criticized for the ease with which the ornamental member has disengaged from the tassel binding band after the closed loop of the prong has opened slightly from normal wear and tear. The prior art prong has also been known to break off from the tassel binding band due to flexure weakening when force is exerted to reclose the loop.

Various attachment assemblies have been attempted to allow the rapid, and secure, attachment and detachment of the ornamental member but these have suffered either from a complexity that makes them unsuitable or a lack of security that allows the ornamental member to be detached during the swaying of the tassel, something that occurs often since, by tradition, graduation students do not treat these items gently.

SUMMARY OF THE INVENTION

An ornament attachment assembly for a tassel having a simple attachment means has been invented which solves the above mentioned problems.

The attachment means comprises a hook element and a suspension ring element or a suspending means. In a first embodiment, the hook element extends from the ornamental member while the suspension ring element extends as an integral part of the binding band, at an angle relative to the binding band, from a bottom portion thereof. The ornamental member is attached to the tassel by insertion of the hook element into the suspension ring element. However the hook element will only be received into the suspension ring element if the ornamental member is in a plane substantially perpendicular to the plane in which the suspension ring element sits.

In a second embodiment the suspending means extends through a lower portion of the binding band. In this embodiment the hook element will be received into the suspending means even when the ornamental member is not in a plane substantially perpendicular to the plane in which the suspending means sits.

In the first embodiment due to the location of the suspension ring element and therefore the shape of the hook element, the hook element will not be received into the suspension ring element unless the tassel and the ornamental member are substantially 90° to each other. In the second embodiment the location of the suspending means through the binding band alleviates the need of substantial perpendicularity between the tassel and the ornamental member for attachment or detachment of the ornamental member. For both embodiments, the tassel portion below the binding band must be bent away from its normal position to allow the hook to be received into, or removed from, the ring element.

A third embodiment has the hook element extending as an integral part of the binding band, at an angle relative to the binding band, from a lower portion thereof. Here again, the suspension ring, now located on the ornamental member, is slipped onto, or removed from, the hook when the tassel portion below the binding band is bent away from the hook at approaching ninety degrees with respect to the upper portion of the tassel. The tassel is then released to hang vertically and in this way prevents the accidental detachment of the ornamental member both because it blocks the opening of the hook and because the tassels themselves prevent the ornamental member from achieving an orientation from which the hook element can disengage from the suspension ring.

Thus the invention ensures that no bending or unbending of a prong to form a closed ring is required and the hook of the invention can have a simple shape and be easily manufactured.

Accordingly, it is an object of the invention to provide an improved attachment means for detachably retaining an ornamental member on a tassel binding band and an improved method for employing such means.

The invention accordingly comprises an ornament attachment assembly and a method of assembling an ornament attachment assembly to a tassel possessing the features of construction, combination of elements and arrangement of parts which will be exemplified and set forth herein, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
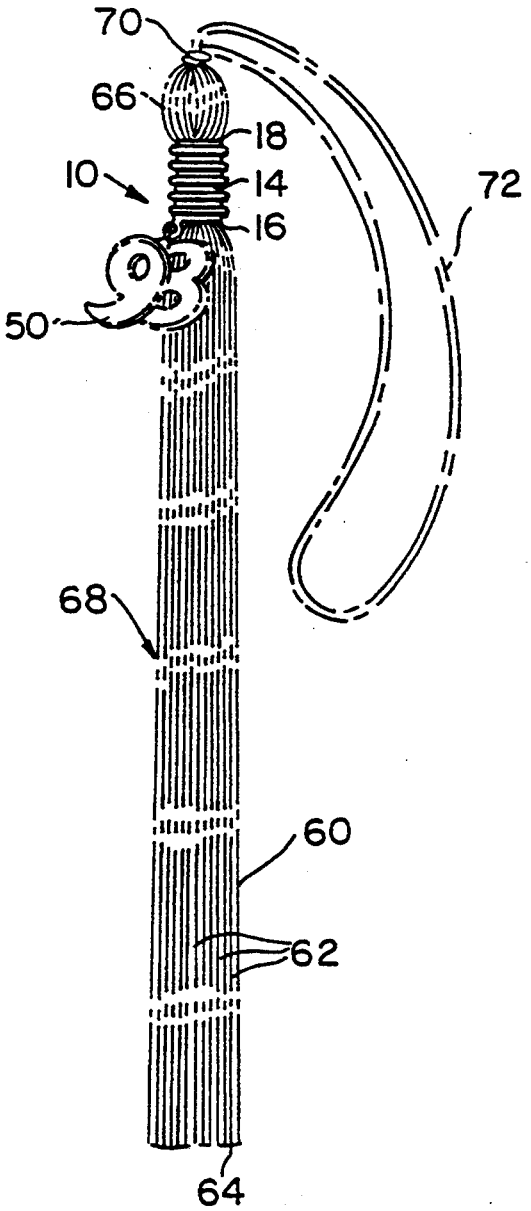
FIG. 1 is a perspective view of a first embodiment of the tassel tag ornament attachment assembly made in accordance with the subject invention.

Referring first to FIG. 1, a first embodiment of an ornament attachment assembly for a tassel is generally indicated at 10. Ornamental attachment assembly 10 is adapted to be used in joining an ornamental member 50 to a tassel 60.

As seen in FIG. 1, tassel 60 consists of a large number of equal length cords 62. Generally, cords 62 of tassel 60 achieve their equal lengths by (1) winding a unitary length of tassel cord around a mandrel (or over a frame) (both not shown) a certain number of revolutions, (2) tying a hanging cord 72 at a lower knot (not shown) and an upper knot 70 around a centrally located point of the cord between the mandrel ends, and (3) cutting the cord at each mandrel end. In this way, each of the revolutions of the unitary cord cut at the mandrel ends creates a cord 62 of tassel 60 which hangs down from hanging cord 72 to end at an end 64. Each of cords 62 is of substantially equal length, as seen in FIG. 1.

Tassel binding band 14 is clamped around cords 62 at a position closer to hanging cord 72 than ends 64 of cords 62. Prior to clamping binding band 14 to tassel 60, binding band 14 is generally a preformed band having a substantially "C" or "U" shape. Binding band 14 is clamped around cords 62 by applying pressure to its ends so that one of these ends wraps around cords 62 from one direction, while the other end wraps around cords 62 from a second direction to abut or close over the first end. In this clamped configuration, binding band 14 is converted from its preclamped initial "C" or "U" shape to a cylindrical shell configuration around cords 62.

Binding band 14 in its clamped position around cords 62 creates two portions of tassel 60. The portion of tassel 60 above binding band 14 is seen at 66 of FIG. 1, while the portion of tassel 60 below binding band 14 is seen at 68 of FIG. 1. Portion 66 consists of the lengths of cords 62 between knot 70 formed in hanging cord 72 and an upper lip 18 of binding band 14. Portion 68 consists of the lengths of cords 62 extending from lower lip 16 of binding band 14 to ends 64. Cords 62 which make up portion 68 are substantially longer than cords 62 which make up portion 66. Cords 62 of portion 68 are free hanging and are each only bound at one end by binding band 14. As will be discussed below, it is the longer length of cords 62 in portion 68 which will assist in keeping ornamental member 50 attached to tassel 60.

Continuing now with FIG. 1, hanging cord 72 has most commonly been used to hang tassel 60 from a graduation hat, or from the rear view mirror of a car. Hanging cord 72 is preferably made from material which is different from the material of cords 62, but may of course be made from the same material as cords 62.

Figure 3:
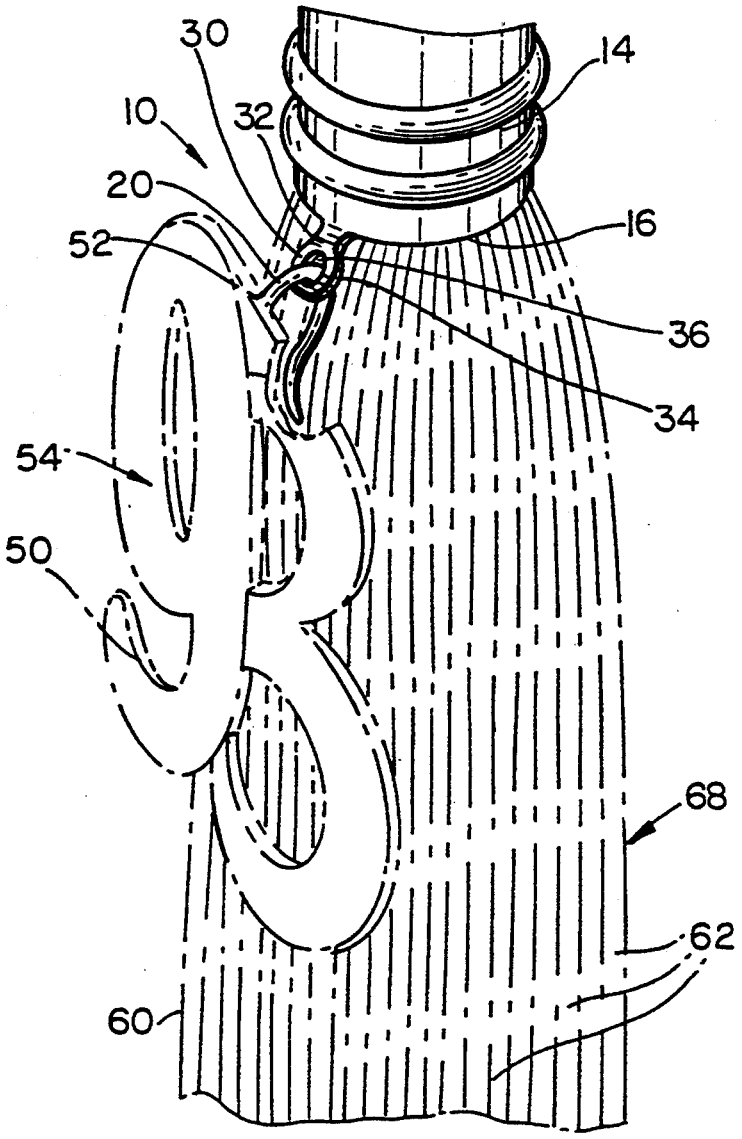
FIG. 3 is a close-up perspective view of the first embodiment of the attachment assembly as shown in FIG. 1.

Turning now to FIG. 3, a close-up of attachment assembly 10 is seen. Attachment assembly 10 comprises a hook element 20 and a suspension ring 30.

FIG. 3 shows one embodiment, the preferred embodiment, of attachment assembly 10. In this preferred embodiment, hook element 20 extends from top 52 of ornamental member 50 and suspension ring 30 extends from lower lip 16 of binding band 14.

Suspension ring 30 can have a neck portion 32 and a head portion 34. Neck portion 32 is integrally connected to lower lip 16 of binding band 14. Head portion 34 has a hole 36 extending therethrough. Hole 36 receives hook element 20 when ornamental member 50 is attached to tassel 60. (Suspension ring 30 may also be constructed so as to consist of only a head portion 34 extending directly out from lower lip 16 of binding band 14. In this way ring 30 would have no neck portion 32. Head portion 34 would still have a hole 36 extending therethrough for receipt of hook element 20.)

Figures 2, 8:
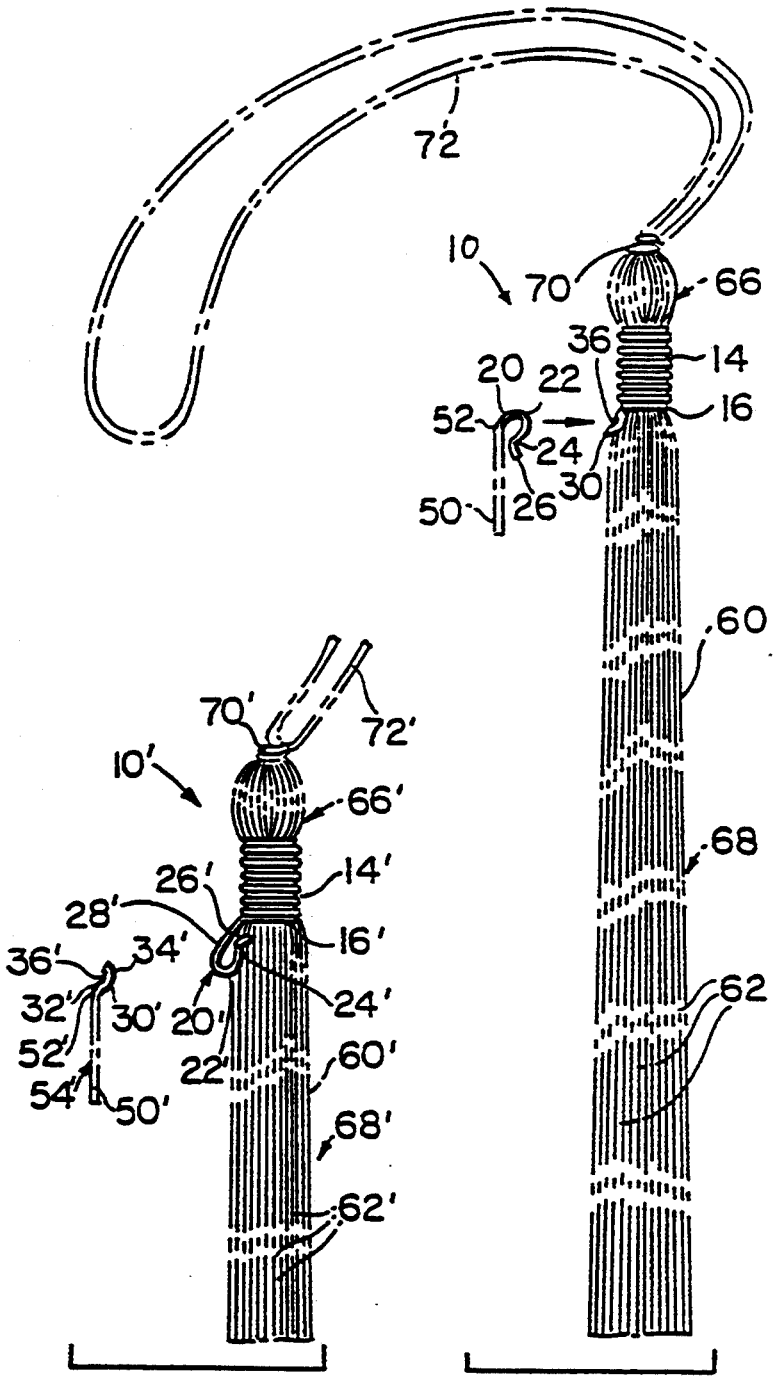
FIG. 2 is an exploded right side elevational view of the tassel ornament attachment assembly shown in FIG. 1.
FIG. 8 is a right side elevational view of a third embodiment of the tassel tag ornament attachment assembly.
Figure 4:
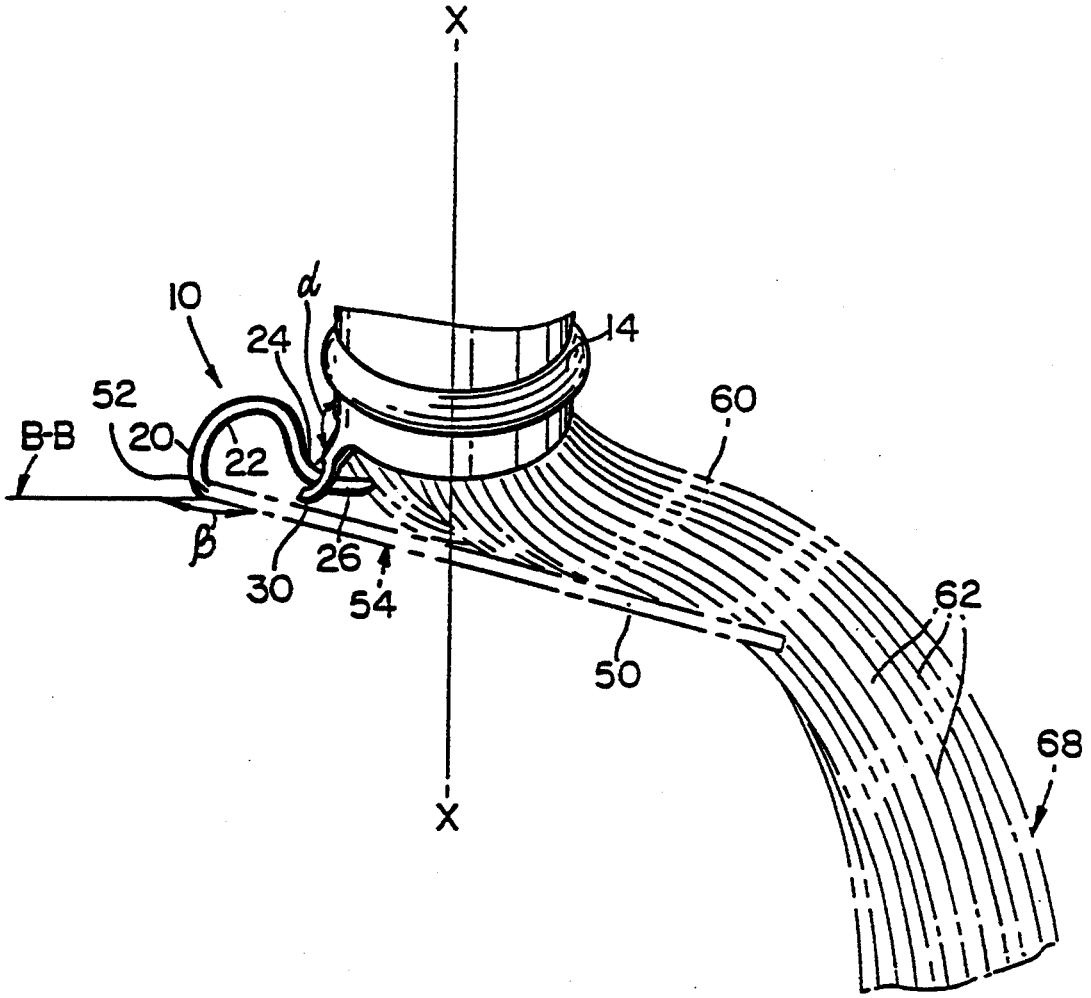
FIG. 4 is a right side elevational view of the attachment assembly of FIG. 3 showing insertion or removal of the hook element from the suspension ring.

For a better understanding of how ornamental member 50 is attached to or detached from tassel 60, attention is now directed to FIGS. 2 and 4. Hook element 20, as seen in FIGS. 2 and 4, essentially has the shape of a stylized capital letter "R" without the middle being closed. Specifically, as seen in elevation in FIG. 2, ornamental member 50 resembles the left most leg of the letter "R". Hook member 20, extending integrally out from ornamental member 50 has looping section 22 starting at top 52 of ornamental member 50 and extending in a semi-circular-type path to elbow 24. Hook element 20 then continues from elbow 24 along leg 26. This overall "R" image of hook element 20 allows for easy attachment and detachment of ornamental member 50 to suspension ring 30, and helps secure ornamental member 50 to suspension ring 30.

As seen in FIG. 4, ornamental member 50 can only be attached (or removed) from tassel 60 if tassel portion 68 is bent away from attachment assembly 10. Ornamental member 50 cannot be attached to or detached from tassel 60 without occupying a plane which is substantially perpendicular to a plane in which suspension ring 30 sits, due to the shape of hook element 20. Specifically, due to the overall shape of hook element 20, and more particularly, elbow 24 between leg 26 and looping section 22, if ornamental member 50 and suspension ring 30 are not in substantially perpendicular planes hook element 20 cannot be inserted (or removed) from suspension ring 30.

As seen in FIG. 4, an angle alpha ($\alpha$) is formed between the plane in which suspension ring 30 sits and binding band 14. Angle alpha has a direct relationship with an angle beta ($\beta$), also seen in FIG. 4. Angle beta is the angle between imaginary line B—B (FIG. 4) and front face 54 of ornamental member 50. Line B—B is perpendicular to symmetry axis x—x of upper and lower portions 66 and 68 of tassel 60. Line B—B passes through the intersection between front face 54 and top surface 52 of ornamental member 50. Angle beta will need to be substantially the same as angle alpha for hook element 20 to be received into (or removed from) hole 36 of suspension ring 30. Therefore, it is seen that hook 20 will not be received into, or removed from, hole 36 unless the plane of ornamental member 50 is substantially perpendicular to the plane of suspension ring 30.

Angle alpha will usually be determined arbitrarily and is dependent upon (1) how many cords 62 there are, (2) how thick each individual cord 62 is or (3) anything which generally affects the overall diameter (thickness) of tassel 60. Angle alpha is not mathematically calculated, nor is it exactingly measured.

In its normal orientation, tassel 60 hangs vertically (i.e., all of tassel 60 including upper and lower portions 66 and 68, respectively). One preferred method (not shown) of bending tassel portion 68 away from assembly 10 to allow attachment or detachment of ornamental member 50 is to (1) hold tassel 60 in its normal vertical orientation by upper portion 66, (2) move portion 66 from its vertical orientation to a horizontal orientation so that (3) assembly 10 is positioned above portion 66. In this way, ring 30 of assembly 10 extends upwardly away from cords 62 of lower portion 68 of tassel 60 which hang down from binding band 14. Cords 62 of portion 68 of tassel 60 will therefore not obstruct insertion (or removal) of hook element 20 into (from) suspension ring 30. When this bending method is used, no tools (e.g., pliers or forming tools) are required to attach or detach ornamental member 50 from tassel 60.

Along these same lines, and continuing with FIG. 4, it is seen that due to the vertically hanging nature of tassel 60 and the need to have angle beta and angle alpha be substantially identical for hook element 20 to disengage from suspension ring 30, ornamental member 50 will not disengage from ring 30 under normal circumstances. Specifically, since lower portion 68 will not achieve an orientation substantially perpendicular to upper portion 66 during normal use, angle alpha will not approach angle beta and portion 68 is seen to block accidental disengagement of hook element 20 from suspension ring 30.

Figure 6:
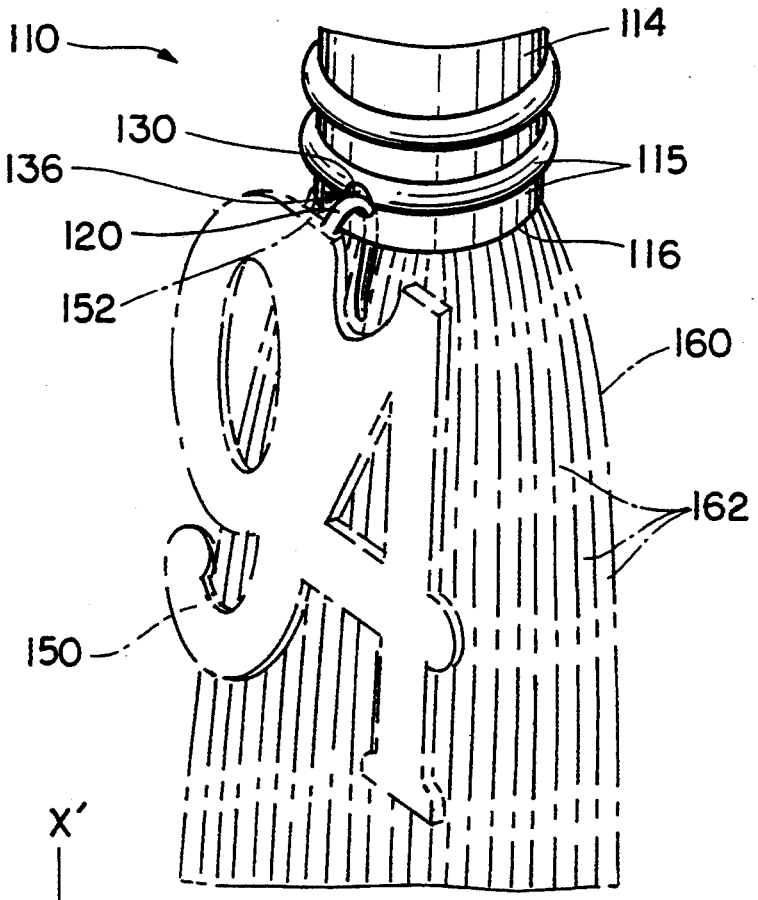
FIG. 6 is a perspective view of a second embodiment of the ornamental attachment assembly for a tassel made in accordance with the subject invention.
Figure 7:
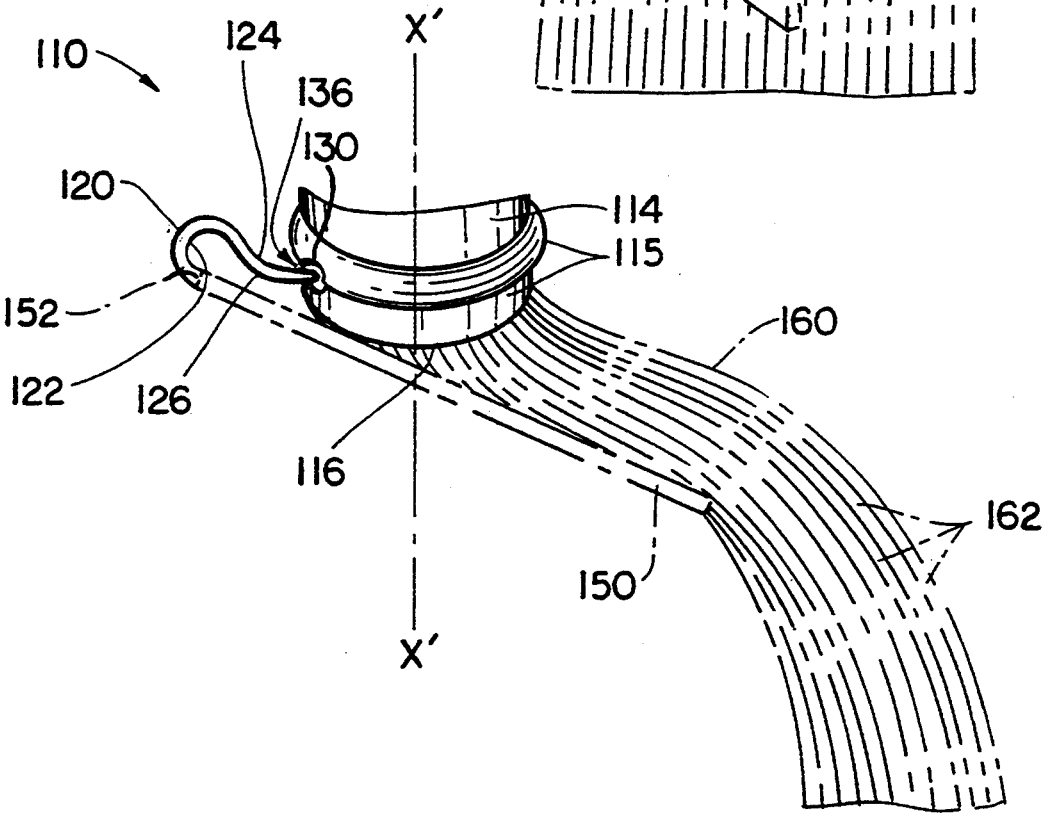
FIG. 7 is a right side elevational view of the attachment assembly of FIG. 6 showing insertion or removal of the hook element from the suspension right element.

Turning now to FIGS. 6 and 7, a second embodiment of attachment assembly 10 is shown at 110. In this embodiment, a hook element 120 extends from a top 152 of an ornamental member 150. Suspending means 130 extends through a lower portion 115 of a binding band 114, suspending means 130 defining a hole 136 through lower portion 115 of binding band 114 for receipt and removal of hook element 120.

For a better understanding of how ornamental member 150 is attached to or detached from a tassel 160, attention is now directed to FIG. 7. As with hook element 20 of attachment assembly 10 of the first embodiment (discussed above), hook element 120 of attachment assembly 110 of the second embodiment also has an essentially "R"-shape, without the middle being closed. As seen in FIG. 7, ornamental member 150 resembles the left most leg of the letter "R." Hook member 120, which extends integrally out from ornamental member 150, has a looping section 122 starting at top 152 of ornamental member 150 which extends in a semi-circular-type path to an elbow 124. Hook element 120 then continues from elbow 124 along leg 126.

As was discussed above in connection with FIG. 4, with respect to attachment and detachment of ornamental member 50 to binding band 14, the plane of ornamental member 50 is required to be substantially perpendicular to the plane of suspension ring element 30 in order for hook element 20 to be inserted into, or removed from, suspension ring element 30. Although this perpendicularity of attachment of embodiment 1 is preferred (because it is inherently more difficult to obtain perpendicularity of chords 62 of tassel 60 as to symmetry axis x—x, and therefore achieve accidental detachment of ornamental member 50), the location of suspension ring means 130 through binding band 114 for embodiment 2 (FIGS. 6 & 7), makes it easier to purposely attach or remove ornamental member 150 while still maintaining the security against accidental detachment of ornamental member 150, due to the overall "R"-shape of hook member 120.

Specifically, the simple repositioning of hole 36, now hole 136, through binding band 114 (FIG. 7), as opposed to the positioning of hole 36 away from lower lip 16 of binding band 14 (FIG. 4), prevents there being enough moveability of tassels 162 to allow ornamental member 150 to obtain a substantially perpendicular orientation. However, there is still the requirement of a substantial displacement of tassel 160 away from symmetry axis x'—x' in order to insert or remove hook element 120 from hole 136. Accordingly, and while maintaining the relationship of inventions between the first and second embodiments, it is the shape of hook element 120 along with the orientation of tassels 162 which dictate whether ornamental member 150 will be received onto, or will be able to be detached from, binding band 114, whether the attachment/detachment is purposeful or accidental.

Figure 5:
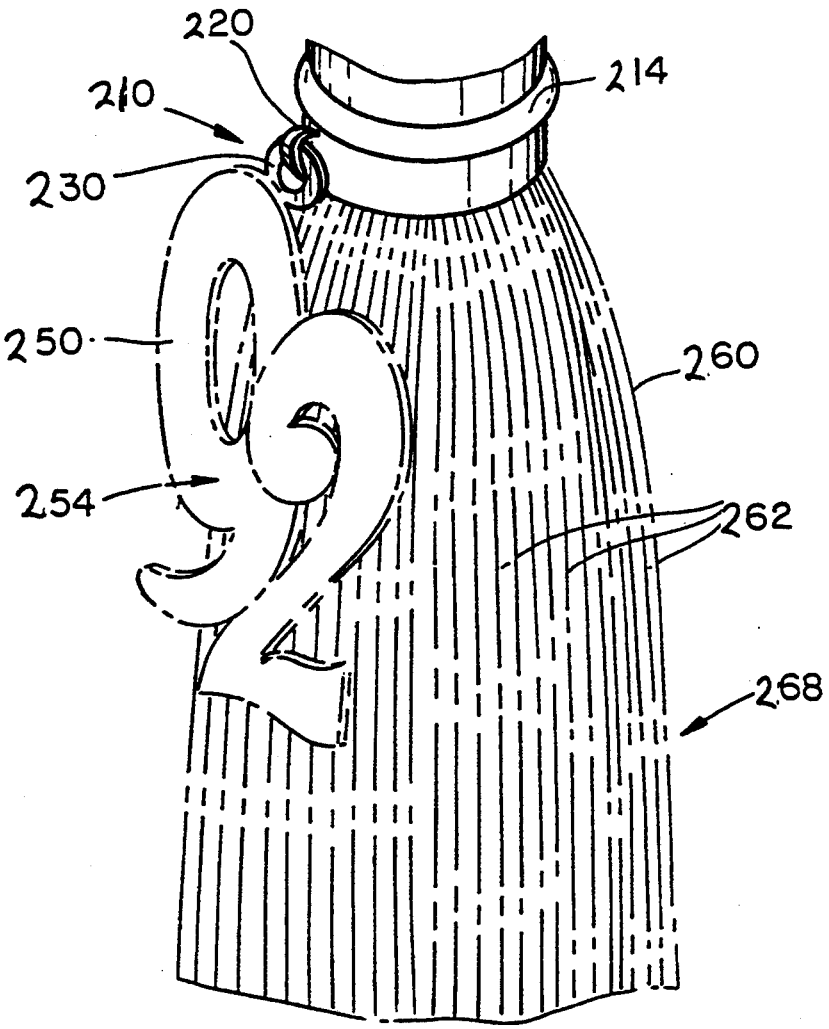
FIG 5 PRIOR ART
FIG. 5 is a perspective view of a prior art tassel tag ornament attachment assembly.

Turning now to FIG. 5, a prior art attachment assembly 210 for a tassel 260 is seen. In this prior art configuration, attachment assembly 210 is seen to join tassel 260 and ornamental member 250 through prong 220 and suspension ring 230.

In contrast to attachment assemblies 10 and 110 of the present invention, prior art tassel tag attachment assemblies 210 consist of prong 220 extending from binding band 214 with suspension ring 230 being a part of ornamental member 250. Prong 220 initially starts out simply as a straight or curved, open piece extending out from binding band 214 and having a hooked end. Prong 220 is then bent by conventional means (e.g., with a pliers or other forming tool) into a closed loop with suspension ring 230 engaged therearound.

An obvious number of disadvantages results from this prior art configuration and consists primarily of the following: (1) a labor intensive procedure which is not economical in employee manufacturing time; (2) flexure failure often occurs at the locations along prong 220 which are bent to secure suspension ring 230 to tassel 260; (3) only slight force is needed to cause prong 220 to loosen from its looped position securing ornamental member 250, thereby giving rise to easy disengagement of ornamental member 250 from tassel 260; and (4) manufacturing these prior art tassel assemblies causes a large number of compliants concerning carpal injuries from workers due to the large number of wrist and hand motions needed for the repetitive task of bending each prong 220 to secure (or remove) ornamental members 250.

Turning now to FIG. 8, a third embodiment of a tassel tag ornament attachment assembly is generally seen at 10'. Attachment assembly 10' consists of suspension ring 30' and hook element 20' for attaching an ornamental member 50' to a tassel 60'.

Continuing with FIG. 8, tassel 60' has cords 62' secured at one end by knot 70' of hanging cord 72' and held together by binding band 14'. Upper portion 66' of tassel 60' is located above binding band 14' while tassel portion 68' is located below binding band 14'.

Extending integrally from a lower lip 16' of binding band 14' is inverted hook element 20'. As seen in FIG. 8, hook element 20' has straight section 28' between binding band 14' and looping section 22' and leg section 26' continuing from looping section 22' and starting at elbow 24'. The configuration of hook element 20' of FIG. 8 is substantially identical to hook element 20 of FIGS. 1–4, except that hook element 20' is inverted and attached to binding band 14'.

As with attachment assembly 10 of embodiment 1 (FIGS. 1–4), suspension ring 30' of FIG. 8 has neck 32' (optional) and head 34' having hole 36' extending completely therethrough. Suspension ring 30' extends from ornamental member 50' at top 52'.

All of the attachment and detachment particulars discussed above for embodiment 1 shown in FIGS. 1–4 hold true for the embodiment shown in FIG. 8. Specifically, due to the shape of hook element 20', ornamental member 50' cannot be secured to or detached from hook element 20' unless suspension ring 30' is substantially perpendicular to straight section 28' of hook element 20'. Therefore, in order to secure or detach ornamental member 50' to tassel 60', tassel portion 68' will have to be bent away from hook element 20' and ornamental member 50' will need to be angled in such a manner that hole 36' of suspension ring 30' can be received over leg section 26' of hook element 20'.

Further, when ornamental member 50' is attached to tassel 60' the location of leg section 26' of hook element 20' within cords 62' of tassel portion 68' has the advantage of closing the opening in hook element 20'. The closure of the opening in hook element 20' and the fact that portion 68' of tassel 60' hangs next to ornamental member 50', both tend to secure the attachment of ornamental member 50' to tassel 60'. Specifically, by preventing ornamental member 50' from achieving a position substantially perpendicular to straight section 28' of hook element 20' and by further preventing suspension ring 30' from disengaging from hook 20' should the proper orientation of ornamental member 50' occur, ornamental member 50' will stay attached to tassel 60'.

It will thus be seen that the objects set forth above, among those made apparent from the preceding description, are efficiently attained, and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that fall therebetween.

I claim:

1. An ornament attachment assembly adapted for use with a tassel adapted to hang in a vertical orientation along an axis, comprising:

a binding band comprising:

a shell; and suspension ring means extending from a lower lip of said shell and integral therewith, said suspension ring means occupying a first plane; and an ornamental member adapted to hang in a vertical orientation and occupying a second plane, comprising hook means extending from said ornamental member for receipt within said suspension ring means when said second plane of said ornamental member is substantially perpendicular to said first plane of said suspension ring means and is intersected by said axis of said tassel.

2. An ornament attachment assembly adapted for use with a tassel, comprising:

a binding band comprising:

a shell; and hook means extending from a lower lip of said shell and integral therewith, said shell adapted to close around said tassel and said hook means having an opening oriented to face said tassel below said lower lip when said shell is closed around said tassel; and an ornamental member having suspension ring means for selective, removable engagement with said hook means when said shell is closed around said tassel.

3. An ornament attachment assembly as recited in claim 2, wherein said suspension ring means occupies a first plane and a straight section of said hook means extending from said lower lip of said binding band occupies a second plane, so that said suspension ring means cannot be selectively, removably engaged with said hook means unless said first plane of said suspension ring means is substantially perpendicular to said second plane of said straight section of said hook means.

4. An ornament attachment assembly, comprising:

a binding band, comprising:

a substantially cylindrical shell having a longitudinal axis therethrough, said cylindrical shell having a lower portion; and means for suspending an ornamental member in a plane parallel to said longitudinal axis, said suspending means extending through said lower portion of said binding band; and a tassel adapted to hang in an orientation-surrounding said longitudinal axis, wherein said ornamental member is selectively attachable to said binding band when said plane of said ornamental member crosses said longitudinal axis.

5. An ornament attachment assembly as recited in claim 4, wherein said ornamental member has hook means extending therefrom for receipt by said suspending means.

6. An ornament attachment assembly as recited in claim 5, wherein said tassel further comprises a plurality of cords.

7. An ornament attachment assembly as recited in claim 6, wherein said plurality of cords of said tassel are substantially parallel to said plane of said ornamental member and help maintain said ornamental member attached to said binding band when said hook means is received by said suspending means.

8. A method of attaching an ornamental member to a binding band of a tassel, said binding band comprising means for suspending said ornamental member and having a longitudinal axis therethrough, said ornamental member comprising hook means extending therefrom and said tassel having a portion below said binding band adapted to hang in an orientation surrounding said longitudinal axis, said method comprising the steps of:

positioning said portion of said tassel below said binding band away from said orientation surrounding said longitudinal axis;

engaging said hook means of said ornamental member with said suspending means; and re-positioning said portion of said tassel below said binding band back in said orientation surrounding said longitudinal axis, thereby enabling said lower portion of said tassel to block movement of said ornamental member so as to restrain said ornamental member from disengaging from said tassel.

9. A method of selectively attaching an ornamental member as recited in claim 8, wherein said positioning step comprises the steps of:

holding said tassel by said binding band so said longitudinal axis of said binding band is surrounded by said lower portion of said tassel and so that said longitudinal axis and said lower portion of said tassel are substantially vertically orientated; and moving said binding band so that said longitudinal axis of said binding band moves from said substantially vertical orientation to a substantially horizontal orientation, said portion of said tassel below said binding band still having said substantially vertical orientation.

10. A method of selectively attaching an ornamental member as recited in claim 9, wherein when said longitudinal axis of said binding band is moved in said moving step from said substantially vertical orientation to said substantially horizontal orientation, said suspending means is oriented above said substantially horizontal orientation of said longitudinal axis of said binding band in a direction away from said below portion of said tassel.

* * * * *